US006093310A

United States Patent [19]

Swan

[11] Patent Number: 6,093,310

[45] Date of Patent: Jul. 25, 2000

[54] FCC FEED INJECTION USING SUBCOOLED WATER SPARGING FOR ENHANCED FEED ATOMIZATION

[75] Inventor: George A. Swan, Baton Rouge, La.

[73] Assignee: Exxon Research and Engineering Co., Florham Park, N.J.

[21] Appl. No.: 09/222,865

[22] Filed: Dec. 30, 1998

[51] Int. Cl.[7] ..... C10G 11/00; C10G 35/00

[52] U.S. Cl. ..... 208/113; 208/153; 208/157

[58] Field of Search ..... 208/113, 153, 208/157

[56] References Cited

U.S. PATENT DOCUMENTS

| | | | |
|---|---|---|---|
| 4,427,537 | 1/1984 | Dean et al. | 208/120 |
| 4,434,049 | 2/1984 | Dean et al. | 208/153 |
| 4,784,328 | 11/1988 | Skraba | 239/432 |
| 5,173,175 | 12/1992 | Steffens et al. | 208/157 |
| 5,289,976 | 3/1994 | Dou et al. | 239/431 |
| 6,003,789 | 12/1999 | Base et al. . | |

*Primary Examiner*—Walter D. Griffin
*Assistant Examiner*—Tam M. Nguyen
*Attorney, Agent, or Firm*—Gerald J. Hughes

[57] ABSTRACT

Atomization of a high boiling point, hot liquid, such as a hydrocarbon feed oil for a fluid cat cracker, is enhanced by injecting subcooled water into the hot liquid, to form a two-phase fluid of the liquid and steam, upstream of the atomization. The hot liquid is at conditions of temperature and pressure effective for the injected, subcooled water to vaporize into steam, when the water contacts it. Typically this means that the hot liquid is hotter and at a lower pressure than the water. In an FCC process, the subcooled water is sparged into the flowing hot oil in a conduit in a riser feed injector. This produces a spray of hot oil in the riser reaction zone in which the oil drops are smaller and more uniformly distributed in the spray.

22 Claims, 3 Drawing Sheets

FCC FEED INJECTION USING SUBCOOLED WATER SPARGING FOR ENHANCED FEED ATOMIZATION

BACKGROUND OF THE DISCLOSURE

1. Field of the Invention

The invention relates to injecting or sparging subcooled water into an FCC feed for enhanced atomization. More particularly, the invention relates to sparging hot, subcooled water into a hotter, lower pressure FCC oil feed, upstream of the feed atomization. The water sparged into the hot oil rapidly vaporizes, forming expanding steam bubbles in the oil and thereby improving the subsequent atomization.

2. Background of the Invention

Atomizing hot, relatively viscous fluids at high flow rates, such as the heavy petroleum oil feeds used in fluidized catalytic cracking (FCC) processes, or fluid cat cracking as it is also called, is an established and widely used process in the petroleum refining industry, primarily for converting high boiling petroleum oils to more valuable lower boiling products, including gasoline and middle distillates such as kerosene, jet and diesel fuel, and heating oil. In an FCC process, the preheated oil feed is mixed with steam or a low molecular weight (e.g., $C_{4-}$) gas under pressure, to form a two phase, gas and liquid fluid. This fluid is passed through a pressure-reducing orifice into a lower pressure atomization zone, in which the oil is atomized and brought into contact with a particulate, hot cracking catalyst. In an FCC process, the riser is both the feed atomization zone and the cat cracking zone. Steam is more often used than a light hydrocarbon gas, to reduce the vapor loading on the gas compression facilities and downstream products fractionation. With the trend toward increasing the fraction of the very heavy and viscous residual oils used in FCC feeds, more steam as a fraction of the oil feed is needed for atomization. However, many facilities have limited steam capacity and this constrains their ability to effectively process heavier feeds. Further, the use of steam produces sour water, which must be treated and disposed of. It would be an improvement in the art, if a way could be found to increase the heavy feed cracking capacity of steam limited plants and also to reduce the amount of steam required for atomization.

SUMMARY OF THE INVENTION

The invention relates to a fluidized catalytic cracking (FCC) process in which a hot FCC feed is atomized as a spray into a riser reaction zone, wherein the process comprises injecting or sparging subcooled water into the flowing hot, liquid feed oil upstream of the feed atomization, and wherein the oil is at conditions effective for the water to vaporize and form a two-phase fluid comprising the hot oil and steam. By subcooled water, is meant hot water at a temperature above its normal atmospheric pressure boiling point and at a pressure sufficient to maintain it in the liquid state, such pressure being greater than the vapor pressure of water at this temperature. By the oil being at conditions effective for the water to vaporize, is meant to include that the respective temperature and pressure of the oil are sufficiently high and low enough to (i) insure vaporization of the water into steam and concomitant formation of a two-phase fluid comprising the steam and hot oil and (ii) maintain a two-phase fluid comprising the steam and hot oil, up to the subsequent atomization of the oil into the riser reaction zone of the fluid cat cracker. As a practical matter and in a preferred embodiment, this means that the oil temperature and pressure are respectively higher and lower than that of the subcooled water. Increasing the pressure drop across the sparger orifices into the hot oil, increases the rapidity of the water vaporizing into steam. Expansion of the steam in the oil enhances the feed atomization into the riser reaction zone. By atomization enhancement is meant that the atomized oil droplets are smaller and the resulting oil spray is more uniform.

More particularly, the invention relates to an FCC process in which the hot, liquid FCC feed oil is introduced, by means of a feed injector, into a cat cracking riser reaction zone as a spray of atomized oil droplets which contact a particulate, hot cracking catalyst, wherein subcooled water is injected or sparged into the flowing hot oil feed, which is at conditions effective for the water to vaporize and form a two-phase fluid of the hot oil and steam, upstream of the atomization. In the practice of the invention, the subcooled water is typically at a temperature lower than the hot FCC oil feed flowing through the feed injector, which is generally not greater than 850° F. and typically ranges from about 500–800° F. When this water contacts the flowing hot oil, its temperature rapidly approaches that of the oil and the water vaporizes into bubbles of steam. The subcooled water in the sparger will typically and preferably be at a pressure greater than that in the feed injector (e.g., >10 atm.), and is injected or sparged into the hot oil feed, through a multiple number of small orifices. This pressure differential across the sparger results in high velocity jets of the subcooled water passing through the sparging orifices, into contact with the flowing hot oil. Vaporization of the water occurs as a result of both the pressure drop from inside the sparger to the outer oil side and the heat transfer from the hot oil to the water droplets and/or vapor bubbles which form superheated steam. For example, assume a hot FCC feed oil at 700° F. and less than 10 atmospheres pressure, upstream of the atomization. At 700° F., pure water has a vapor pressure of about 211 atmospheres. This provides a very large (>200 atm) potential pressure differential for steam formation and expansion as bubbles in the oil. As a consequence of this very high pressure differential, the superheated water droplets formed in the oil by sparging rapidly Vaporize, to form a two phase fluid comprising bubbles of steam dispersed in the hot oil. Since the amount of water injected into the hot oil is relatively minor compared to the oil mass (e.g., 1–2 wt. % of the oil), the quench effect of the water sparging is typically within 10–20° F., which is not detrimental to the subsequent atomization of the hot oil. This two-phase fluid may remain as an oil continuous fluid, or it may change to a steam continuous fluid prior to atomization, depending on the conditions and the distance from the downstream atomization. During atomization, the fluid typically passes through an atomizing means, typically comprising a nozzle or orifice, into a lower pressure atomizing zone, which forms a spray of atomized oil droplets. The atomization zone comprises an expansion zone, sufficiently large enough to enable the formation of the atomized oil spray. A controlled expansion means immediately downstream of, or which forms part of the atomizing means, such as an atomizing or spray tip, may be used as a controlled expansion zone, to control the size and shape of the spray being injected into the reaction zone. This is known and is preferred in the practice of the invention. The pressure drop across an atomizing means for a typical FCC feed injector is in the range of from about 1–5 atmospheres. The atomizing orifice typically has a cross-section area normal to the flow direction of the fluid, less than that of the conduit(s) feeding the fluid to it. This increases the flow velocity and shear between the oil and steam. The combination of steam expansion and shear into the lower pressure atomization zone, causes the oil to break up into small droplets in the form of a spray.

In a broader sense, the invention relates to a process for atomizing a high boiling point, hot feed liquid, which comprises injecting or sparging subcooled water into the hot liquid flowing through a conduit, wherein the liquid is at conditions of temperature and pressure effective to vaporize the water and form a two-phase fluid comprising a mixture of steam and the liquid, and passing this two-phase fluid through an atomizing means into a lower pressure expansion zone, to atomize the liquid and form a spray comprising droplets of the atomized liquid. The atomizing means may comprise an orifice having a cross-sectional area smaller than that of the conduit upstream. By high boiling feed liquid is meant a liquid boiling above 500° F., and preferably a hydrocarbon liquid boiling above 500° F. In a more detailed embodiment relating to FCC feed atomization, the invention comprises a fluid cat cracking process, which comprises the steps of:

(a) injecting subcooled water into a hot, liquid FCC feed oil flowing through a conduit under pressure in a feed injector, in which the oil is at conditions of temperature and pressure effective to vaporize the water and form a fluid comprising a mixture of steam and feed oil;

(b) passing the fluid mixture through an atomizing means and into a lower pressure atomization zone comprising a riser reaction zone, to atomize the feed into a spray comprising atomized droplets of the oil, and (c) contacting the atomized oil with a particulate, hot, regenerated cracking catalyst in the riser reaction zone, at reaction conditions effective to catalytically crack the oil and produce lower boiling hydrocarbons.

The cracking reaction produces spent catalyst particles, which contain strippable hydrocarbons and coke. The lower boiling hydrocarbons are separated from the spent catalyst particles in a separation zone and the spent catalyst particles are stripped in a stripping zone, to remove the strippable hydrocarbons to produce stripped, coked catalyst particles. The stripped, coked catalyst particles are passed into a regeneration zone, in which they are contacted with oxygen, at conditions effective to bum off the coke and produce the hot, regenerated catalyst particles, which are then passed back up into the riser reaction zone.

DETAILED DESCRIPTION

Figure 1:
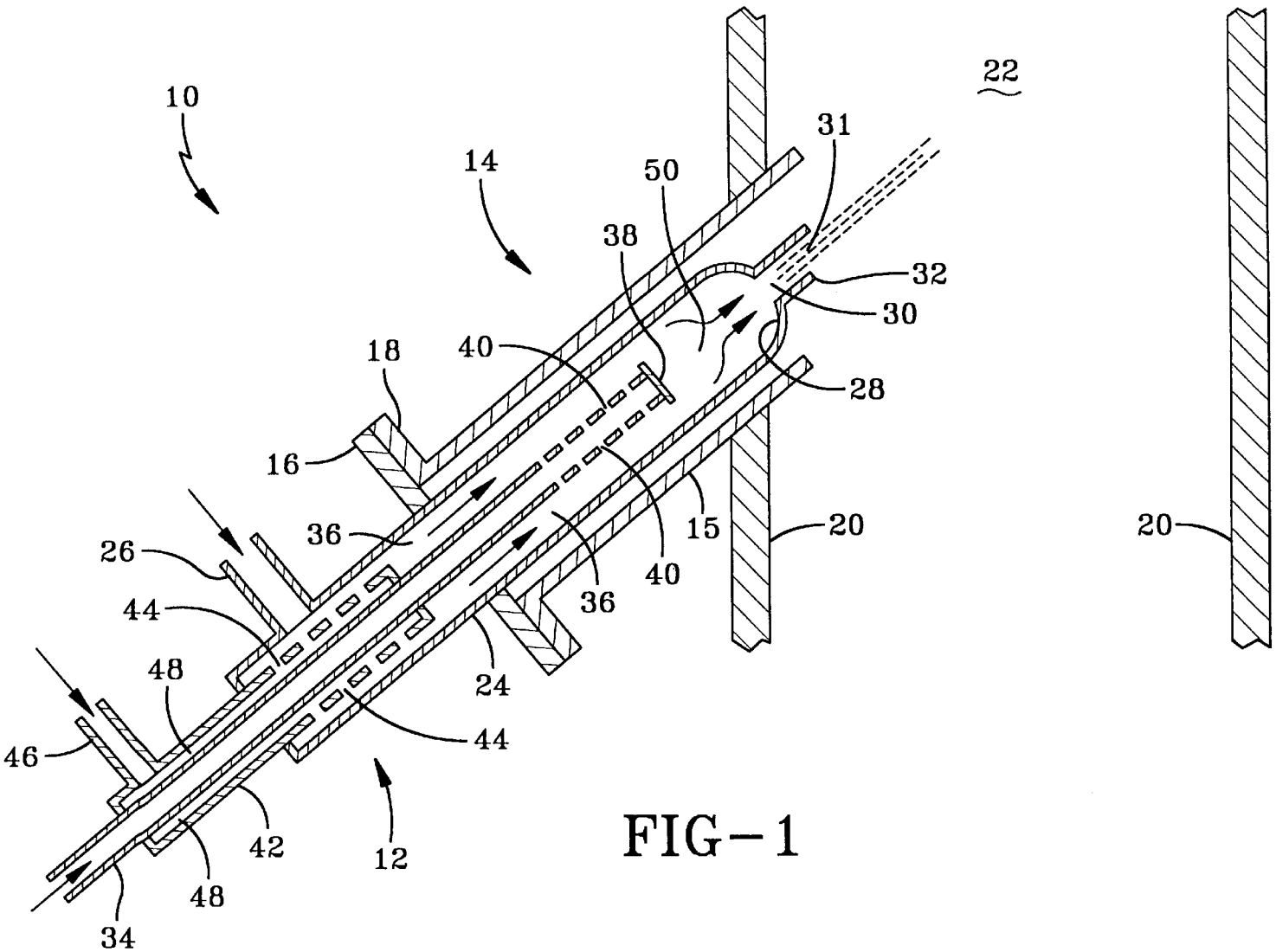
FIG. 1 is a schematic side view of an FCC feed injection unit useful in the practice of the invention.

Referring to FIG. 1, an FCC feed injection unit 10 useful in the practice of the invention comprises a hollow feed injector 12, attached to a nozzle means 14, by means of respective flanges 16 and 18. Nozzle means 14 is shown as a conduit 15, penetrating through the wall 20 of an FCC riser and into the riser reaction zone 22. The riser is a cylindrical, hollow, and substantially vertically oriented conduit, in a portion of which (the riser reaction zone) the atomized oil feed contacts the uprising, hot catalyst particles and is cracked into more useful, lower boiling hydrocarbon products. Only a portion of the riser conduit is shown for convenience. The feed injector means 12 comprises a hollow conduit 24, into which the preheated oil feed is introduced via feed line 26, which forms a T-junction with the wall of the upstream portion of the injector. The downstream portion of the injector terminates in a hemispherical or curved wall 28, having a centrally located atomizing orifice 30 of substantially smaller cross-sectional area than that of the conduit, with a fan-shaped distributor 32 on its downstream side, for producing a relatively flat, fan-shaped spray of the atomized oil into the riser reaction zone 22. This distributor is also referred to as an atomizing or spray tip. The combination of a non-circular orifice and fan-shaped distributor is disclosed and claimed in U.S. Pat. No. 5,173,175, the disclosure of which is incorporated herein by reference. This type of injector produces excellent radial distribution of the atomized oil, with a low pressure drop (e.g., <50 psi). Employing a curved or hemispherical end wall reduces coalescence of the dispersed oil droplets, which would otherwise occur by impingement of the fluid onto a flat end wall. A subcooled water sparging conduit 34, having a smaller diameter or cross-sectional area than the injector conduit 24, extends into and is axially aligned with the longitudinal axis of conduit 24. In this embodiment, the central, longitudinal axes of both conduits are coincident. This provides an annular flow path 36 for the hot oil, upstream of the exit end of the injector. Subcooled water conduit 34 terminates inside conduit 24 in a static mixing means 38, upstream of the atomizing end of the injector. In this embodiment, the static mixing means comprises a baffle means in the form of a disk, having a diameter or cross-sectional area slightly larger than that of conduit 34, welded to its end. This baffle static mixing means induces additional flow turbulence with a minimal pressure drop. In other embodiments it may comprise a ring or a plurality of tabs extending radially inward from the inner wall of conduit 24, and the like. A plurality of holes or orifices 40, radially drilled circumferentially around the end portion of 34, provide the means for sparging the subcooled water radially out and into the annularly surrounding, hot oil flowing downstream towards the atomizing end of the injector. As a practical matter, the distance between the end of the sparging means and the atomizing orifice will typically be less than ten and more typically less than five times the diameter (ID) of the injector conduit 24. The end of the sparging means is the end of the sparging zone as defined by the most downstream subcooled water sparging orifices in the sparger. The amount of subcooled water sparged into the oil is typically between 1 and 2 wt. % of the hot oil feed. A preferred option, also shown in FIG. 1, is a means for continuously injecting purge steam into the injector, to keep it clear in the event of feed interruptions. It also serves as a steam back-up to keep the unit operating, in the event there is an interruption in the subcooled water supply. This purge steam option is shown as a conduit 42, which extends longitudinally into and towards the upstream end of the injector, annularly surrounding a portion of the subcooled water conduit 34, with the outer wall surface of water conduit 34 forming the radially interior wall of the steam flow path. The steam is injected into the purge conduit via steam line 46 and into the annular flow path 48. The downstream end of 42, which is enclosed within conduit 24, contains a plurality of holes or orifices 44, radially drilled circumferentially around the end portion thereof as shown, to provide the means for sparging the purge steam radially outward and into the annularly surrounding hot oil feed flowing through the injector. Purge steam orifices 44 are typically larger in diameter than the subcooled water sparging orifices 40 and the pressure drop across orifices 44 is typically less than 10 psi. If this preferred option is used, the amount of purge steam is generally less than one half percent by weight, and more typically, no more than about one-quarter percent by weight of the hot oil feed. In operation, as the hot FCC feed oil passes through the annular flow path 36 in injector 10, purge steam at a temperature and pressure of, for example, about 365° F. and 150 psig, is passed into the oil, which forms a two-phase fluid mixture of the steam and the oil. It also provides some pre-heating of the subcooled water stream flowing through the sparger pipe, prior to direct contact of the sparger pipe 34 with the flowing hot oil. As this fluid mixture flows past the sparger at the downstream end of conduit 34, the subcooled water is injected into the flowing hot oil. Due to the relatively high pressure drop across the sparging orifices and the relatively small diameter of the orifices themselves, the water passes out of the sparger as jets of relatively high velocity. For the sake of illustration, a subcooled water temperature of about 350° F. and 200 psig. pressure in the sparging pipe or conduit is assumed. As the water is pumped through the pipe in contact with the 550° F. hot oil, which is at a pressure of 82 psig., the temperature of the subcooled water increases, due to heat transfer between the flowing hot oil in contact with the outside surface of the sparging pipe and the subcooled water inside the pipe. The water pump (not shown) discharge pressure, in combination with the size of the restrictive sparging orifices, is sufficient to maintain the water substantially in the liquid state, prior to its injection into the flowing oil through the sparging orifices 40. Water at 550° F. has a vapor pressure of 1048 psia and this provides a high pressure differential of 951 psi for vapor expansion of the water bubbles. Typical sparging orifices will be less than ⅛th of an inch in diameter. The jets of subcooled water forced through the sparging orifices will typically have a velocity greater than 100 ft./sec. Water used for sparging is preferably demineralized or deionized to prevent scale deposition in the sparger pipe and plugging of the sparger orifices. While not wishing to be held to any particular theory, it is believed that the subcooled water injected into the flowing hot oil breaks up into small droplets in the oil. Due to the pressure drop across the sparging orifices and rapid heat transfer to the injected water, the resulting superheated water droplets vaporize in the oil substantially instantaneously, to form a two-phase fluid mixture comprising steam bubbles dispersed in the hot oil. As this mixture passes over the low pressure drop baffle means 38, additional turbulence and shear mixing occurs. This fluid progresses into a mild expansion zone 50, located between the end of the sparger and the atomizing orifice 30, which permits the steam to expand. Vigorous vaporization of the steam bubbles produces a substantial turbulence and shear mixing in the fluid mixture, which may now be a bubbly froth. The resulting fluid mixture, which may typically comprise, on a volume basis, 75–85% steam and 15–25% oil, passes into the expanded throat portion 50 of conduit 24, in which further steam expansion and shear mixing occurs, thereby further reducing the size of the oil globules. This expansion zone should not be so long as to permit agglomeration of oil globules formed during the expansion and mixing, and this is determined experimentally. The fluid then passes out through atomizing orifice 30 and into a lower pressure, controlled expansion zone 31. As it passes through the atomizing orifice, significant shearing between the steam and oil globules occurs, due to the velocity increase caused by the smaller diameter orifice. Additional shearing occurs as the fluid expands, first in the controlled expansion zone 31 and then in riser reaction zone 22. The atomizing orifice and expansion zone 31, are both in fluid communication with the lower pressure riser reaction zone 22. This shearing and controlled expansion form a relatively flat, fan-shaped spray of finely atomized droplets of the hot oil feed. In plan view, the atomizing or spray tip 32, the interior of which comprises the controlled expansion zone 31, will appear as a truncated V, with outwardly expanding side walls in order for the atomized spray to achieve the desired fan shape. This spray proceeds into the riser reaction zone 22, in which it contacts an upflowing stream of hot catalyst particles (not shown), which catalytically crack the heavy oil feed into the desired lower boiling product fractions. In this specific embodiment illustrating the practice of the invention, only one type of fan spray nozzle is shown. However, other atomizing orifice and nozzle configurations may also be used, such as those disclosed, for example, in U.S. Pat. Nos. 4,784,328 and 5,289,976 and the like.

Figure 2:
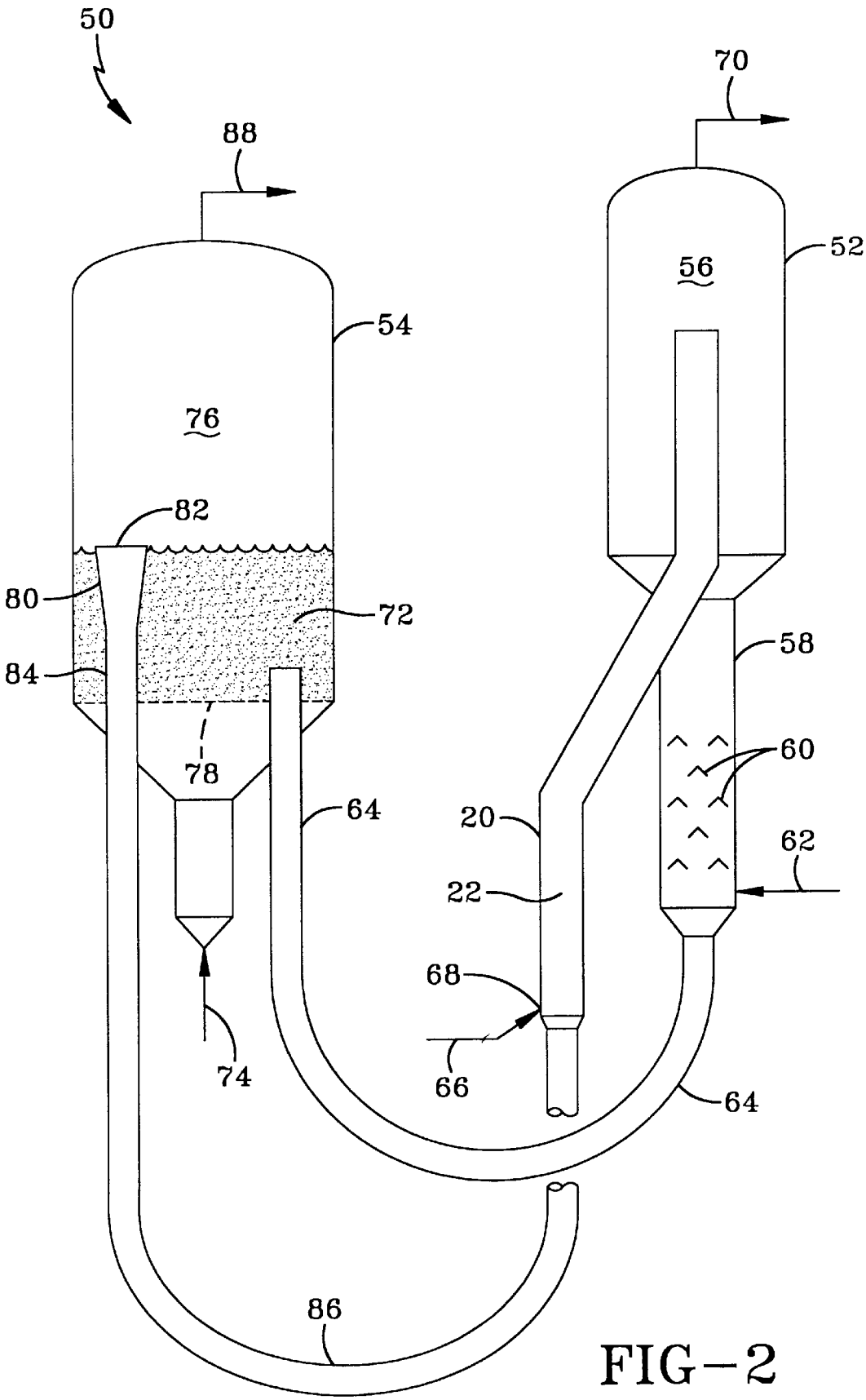
FIG. 2 is a simplified schematic of a fluid cat cracking process useful in the practice of the invention.

FIG. 2 is a simplified schematic of a fluid cat cracking process used in conjunction with the feed injection method of the invention. Turning to FIG. 2, an FCC unit 50 useful in the practice of the invention is shown comprising a catalytic cracking reactor unit 52 and a regeneration unit 54. Unit 52 includes a feed riser 20, the interior of which comprises the reaction zone, the beginning of which is indicated as 22. It also includes a vapor-catalyst disengaging zone 56 and a stripping zone 58 containing a plurality of baffles 60 within, in the form of arrays of metal "sheds" which resemble the pitched roofs of houses. A suitable stripping agent such as steam is introduced into the stripping zone via line 62. The stripped, spent catalyst particles are fed into regenerating unit 54 via transfer line 64. A preheated FCC feed is passed via line 66 into the base of riser 20 at feed injection point 68 of the fluidized cat cracking reactor unit 52. The feed injector shown in FIG. 1 is located at 68, but is not shown in this figure, for simplicity. In practice, a plurality of feed injectors will be circumferentially located around the feed injection area of riser 20. Also not shown are the hot water and steam lines associated with the feed atomization and injection. The feed comprises a mixture of a vacuum gas oil (VGO) and a heavy feed component, such as a resid fraction. The atomized droplets of the hot feed are contacted with particles of hot, regenerated cracking catalyst in the riser. This vaporizes and catalytically cracks the feed into lighter, lower boiling fractions, including fractions in the gasoline boiling range (typically 100–400° F.), as well as higher boiling jet fuel, diesel fuel, kerosene and the like. The cracking catalyst is a mixture of silica and alumina containing a zeolite molecular sieve cracking component, as is known to those skilled in the art. The catalytic cracking reactions start when the feed contacts the hot catalyst in the riser at feed injection point 68 and continues until the product vapors are separated from the spent catalyst in the upper or disengaging section 56 of the cat cracker. The cracking reaction deposits strippable hydrocarbonaceous material and non-strippable carbonaceous material known as coke, to produce spent catalyst particles which must be stripped to remove and recover the strippable hydrocarbons and then regenerated by burning off the coke in the regenerator. Reaction unit 52 contains cyclones (not shown) in the disengaging section 56, which separate both the cracked hydrocarbon product vapors and the stripped hydrocarbons (as vapors) from the spent catalyst particles. The hydrocarbon vapors pass up through the reactor and are withdrawn via line 70. The hydrocarbon vapors are typically fed into a distillation unit (not shown) which condenses the condensable portion of the vapors into liquids and fractionates the liquids into separate product streams. The spent catalyst particles fall down into stripping zone 58, in which they are contacted with a stripping medium, such as steam, which is fed into the stripping zone via line 62 and removes, as vapors, the strippable hydrocarbonaceous material deposited on the catalyst during the cracking reactions. These vapors are withdrawn along with the other product vapors via line 70. The baffles 60 disperse the catalyst particles uniformly across the width of the stripping zone or stripper and minimize internal refluxing or backmixing of catalyst particles in the stripping zone. The spent, stripped catalyst particles are removed from the bottom of the stripping zone via transfer line 64, from which they are passed into fluidized bed 72 in regenerator 54. In the fluidized bed they are contacted with air entering the regenerator via line 74 and some pass up into disengaging zone in the regenerator. The air oxidizes or burns off the carbon deposits to regenerate the catalyst particles and in so doing, heats them up to a temperature which typically ranges from about 950–1400° F. Regenerator 54 also contains cyclones (not shown) which separate the hot regenerated catalyst particles from the gaseous combustion products (flue gas) which comprises mostly $CO_2$, CO and $N_2$ and feeds the regenerated catalyst particles back down into fluidized catalyst bed 72, by means of diplegs (not shown), as is known to those skilled in the art. The fluidized bed 72 is supported on a gas distributor grid, which is briefly illustrated as dashed line 78. The hot, regenerated catalyst particles in the fluidized bed overflow the weir 82 formed by the top of a funnel 80, which is connected at its bottom to the top of a downcomer 84. The bottom of downcomer 84 turns into a regenerated catalyst transfer line 86. The overflowing, regenerated particles flow down through the funnel, downcomer and into the transfer line 86 which passes them back into the riser reaction zone, in which they contact the hot feed entering the riser from the feed injector. The flue gas is removed from the top of the regenerator via line 88.

Cat cracker feeds used in FCC processes typically include gas oils, which are high boiling, non-residual oils, such as a vacuum gas oil (VGO), a straight run (atmospheric) gas oil, a light cat cracker oil (LCGO) and coker gas oils. These oils have an initial boiling point typically above about 450° F. (232° C.), and more commonly above about 650° F. (343° C.), with end points up to about 1150° F. (621° C.), as well as straight run or atmospheric gas oils and coker gas oils. In addition, one or more heavy feeds having an end boiling point above 1050° F. (e.g., up to 1300° F. or more) may be blended in with the cat cracker feed. Such heavy feeds include, for example, whole and reduced crudes, resids or residua from atmospheric and vacuum distillation of crude oil, asphalts and asphaltenes, tar oils and cycle oils from thermal cracking of heavy petroleum oils, tar sand oil, shale oil, coal derived liquids, syncrudes and the like. These may be present in the cracker feed in an amount of from about 2 to 50 volume % of the blend, and more typically from about 5 to 30 volume %. These feeds typically contain too high a content of undesirable components, such as aromatics and compounds containing heteroatoms, particularly sulfur and nitrogen. Consequently, these feeds are often treated or upgraded to reduce the amount of undesirable compounds by processes, such as hydrotreating, solvent extraction, solid absorbents such as molecular sieves and the like, as is known. Typical cat cracking conditions in an FCC process include a temperature of from about 800–1200° F. (427–648° C.), preferably 850–1150° F. (454–621° C.) and still more preferably 900–1150° F. (482–621° C.), a pressure between about 5–60 psig, preferably 5–40 psig with feed/catalyst contact times between about 0.5–15 seconds, preferably about 1–5 seconds, and with a catalyst to feed ratio of about 0.5–10 and preferably 2–8. The FCC feed is preheated to a temperature of not more than 850° F., preferably no greater than 800° F. and typically within the range of from about 500–800° F.

The invention will be further understood with reference to the following example.

EXAMPLE

The process of the invention may be demonstrated using a mathematical model developed by Sher and Elata (Sher, E and Elata, C, "Spray formation from Pressure Cans by Flashing", Ind. Eng. Chem. Process Des. Dev., v.6, n.2, p.237–422, 1977) to approximate the atomized oil droplet size as a function of the wt. % subcooled water sparged into the feed oil. An FCC feed comprising a blend of a VGO, a lube oil extract and a vacuum resid, was used for the calculations. The feedstock properties are given in Table 1 below.

TABLE 1

| | |
|---|---|
| Gravity, API | 20.1 |
| Refractive Index at 67° C. | 1.503 |
| Conradson Carbon, wt. % | 1.6 |
| Carbon, wt. % | 86.07 |
| Hydrogen, wt. % | 11.76 |
| Sulfur, wt. % | 1.65 |
| Nitrogen, wt. % | 0.13 |

The preheated feed temperature and pressure were taken at 550° F. and 82 psig., respectively, with a riser reaction zone pressure of 30 psig. A case for injecting water at 350° F. and 200 psig was considered to computationally test the effect of direct water injection on droplet diameter of the atomized oil. It was also assumed that the temperature of the subcooled water droplets sparged into the hot oil feed rapidly approaches oil temperature, so the atomization calculation was simplified based upon water at 550° F. The effect of the small flow of the purge steam added to the oil prior to injection of the subcooled water was ignored. The properties of the oil feed and water are tabulated in Table 2 below.

TABLE 2

| Property @ 550° F. | Oil Feed | Water |
|---|---|---|
| MW, g/mole | 430 | 18 |
| Liquid density, g/cc | 0.70502 | 0.958 |
| Heat capacity, cal/g-°K. | 0.646 | 1.11 |
| Thermal diffusivity, $cm^2/s$ | 4.22E-04 | 1.26E-03 |
| Surface tension, dynes/cm | 17.6 | 14.5 |
| Heat of vaporization, cal/g | | 357.4 |

At 550° F., the vapor pressure of liquid water is 1048 psia. This provides a high pressure differential of 951 psi for vapor expansion as bubbles in the injector oil side, and subsequently as the oil/steam mixture exits the atomizing orifice as a spray into the riser. The steam expansion breaks up the oil phase to create smaller droplets.

The Sher and Elata theory and their derived dropsize prediction equation (the equation 15 on page 239) was used to approximate atomization behavior of oil, with flashing water droplets dispersed in the oil phase. A dimensionless coefficient must be estimated, to account for the bubble growth rate under conditions in which thermal equilibrium is not achieved. Since the pressure differential between the preheated oil and the vapor pressure at the oil temperature in the process of this invention is an order of magnitude greater than that used for the Hooper and Abdelmessih data, which Sher and Elata used and reproduced in their article, the asymptotic region in the curve reproduced in the article (FIG. 10 on page 241) was used to approximate the dimensionless coefficient for water as equal to 0.35 with a 68 atm pressure differential.

Figure 3:
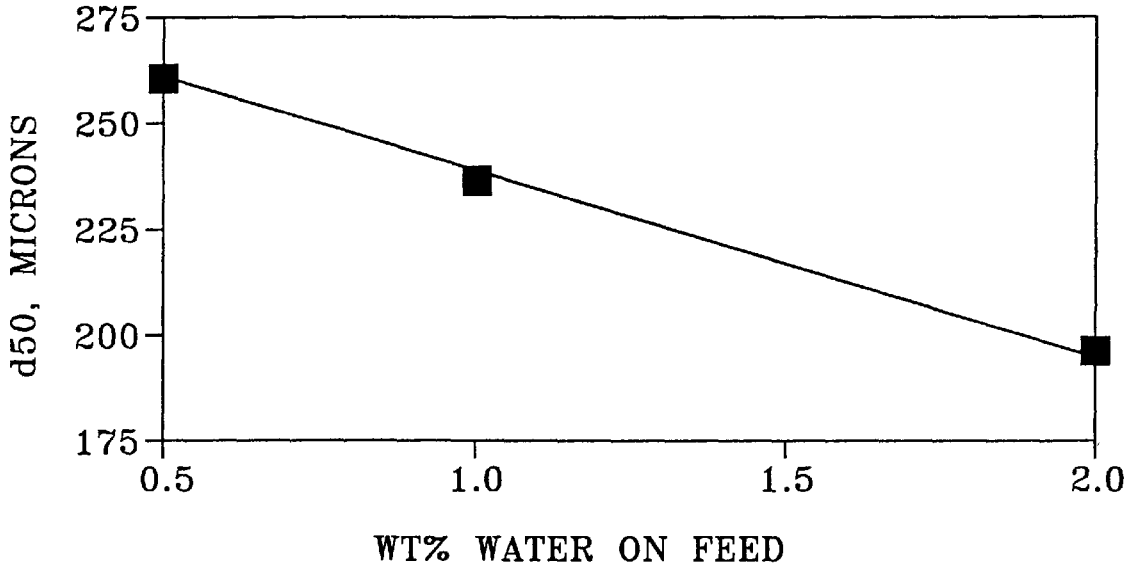
FIG. 3 is a graph illustrating the effect of the injected water content on the atomized oil feed droplet diameter.

The results of the calculations are shown in FIG. 3, which shows the estimated mass mean oil droplet diameter, $d_{50}$ as a function of wt. % water injected into the oil. Dropsizes in the range of 200–300 microns are achievable with less than 1 wt. % water addition, based on the weight of the hot oil feed.

The results show that the application of the process of the invention, using a conventional injector tip (operating with a 25–60 psi orifice ΔP), as described and referred to above and in FIG. 1, for the final atomization, will reduce the oil mean drop diameter from the current 300–400 micron range, down to the 200–300 micron range. Furthermore, although not quantified, it is expected that the dropsize distribution resulting from enhanced ligament breakup using water injection, will provide a more uniform dropsize distribution. This will significantly lower the fraction of larger oil drops in the spray.

It is understood that various other embodiments and modifications in the practice of the invention will be apparent to, and can be readily made by, those skilled in the art without departing from the scope and spirit of the invention described above. Accordingly, it is not intended that the scope of the claims appended hereto bc limited to the exact description set forth above, but rather that the claims be construed as encompassing all of the features of patentable novelty which reside in the present invention, including all the features and embodiments which would be treated as equivalents thereof by those skilled in the art to which the invention pertains.

What is claimed is:

1. A process for atomizing a liquid boiling above 500° F. comprises injecting subcooled water into a flowing stream of said liquid, with said flowing liquid at conditions of temperature and pressure effective to vaporize said water and form steam, to form a two-phase fluid comprising a mixture of said steam and liquid, and passing said fluid through an atomizing means and into an atomizing zone, to atomize said liquid and form a spray comprising drops of said atomized liquid, the drops having a mass mean droplet diameter ranging from about 200 to about 300 microns.

2. A process according to claim 1 wherein said liquid comprises a hydrocarbon.

3. A process according to claim 2 wherein said conditions include a pressure lower than the pressure of said subcooled water, prior to said water being injected into said flowing liquid.

4. A process according to claim 3 wherein said atomizing zone is at a pressure lower than said pressure effective to vaporize said water to steam.

5. A process according to claim 4 wherein said atomizing means comprises an orifice.

6. A process according to claim 5 wherein said two-phase fluid is passed to said orifice by means of a conduit which has a cross-sectional area normal to the direction of flow of said fluid, larger than the cross-sectional area of said orifice normal to said flow direction.

7. A process of claim 6 wherein said atomizing means also includes an atomizing tip which controls the size and shape of said spray.

8. A process according to claim 7 wherein said fluid contacts a static mixing means prior to said atomization.

9. A process according to claim 6 wherein said water is injected into said liquid by a sparging means.

10. A process according to claim 7 wherein said water is injected into said liquid by a sparging means.

11. A fluid cat cracking process which comprises the steps of:

(a) injecting subcooled water into a hot, liquid FCC feed oil flowing through a conduit under pressure in a feed injector, in which the oil is at conditions of temperature and pressure effective to vaporize said water and form a two-phase fluid comprising a mixture of steam and said feed oil;

(b) atomizing said fluid to form a spray comprising atomized drops of said feed oil, wherein the mass mean droplet diameter ranges from about 200 to about 300 microns, and (c) contacting said atomized oil spray with a particulate, hot, regenerated cracking catalyst in a riser reaction zone at reaction conditions effective to catalytically crack said feed oil and produce lower boiling hydrocarbons.

12. A process according to claim 11 wherein said fluid is atomized by passing it through an atomizing means.

13. A process according to claim 12 wherein said conditions of temperature and pressure of said feed in said conduit include a pressure lower than that of said water.

14. A process according to claim 13 wherein said conditions of temperature and pressure of said feed in said conduit include a temperature higher than that of said water.

15. A process according to claim 14 wherein said atomizing means comprises an atomizing orifice which comprises part of said injector.

16. A process according to claim 15 wherein said atomizing means also comprises an atomizing tip for controlling the size and shape of said spray.

17. A process according to claim 16 wherein said atomizing orifice increases the velocity of said fluid passing therethrough.

18. A process according to claim 17 wherein said atomization occurs in an atomizing zone downstream of said orifice.

19. A process according to claim 18 wherein said atomizing zone comprises said riser reaction zone and is at a pressure lower than that of said fluid in said conduit.

20. A fluid cat cracking process which comprises the steps of:

(a) injecting subcooled water by sparging means into a hot, liquid FCC feed oil flowing through a conduit under pressure in a feed injector, in which the oil is at conditions of temperature and pressure effective to vaporize the water and form a two-phase fluid comprising a mixture of steam and said feed oil, said conditions comprising a feed oil pressure lower than said water's vapor pressure at said oil temperature;

(b) passing said fluid mixture through an atomizing means, which includes an atomizing tip, and into a lower pressure atomization zone to atomize said feed oil into a spray comprising droplets of said feed oil, wherein the tip controls the size and shape of said spray;

(c) contacting said atomized oil spray with a particulate, hot, regenerated cracking catalyst in a riser reaction zone, at reaction conditions effective to catalytically crack said feed oil and produce lower boiling hydrocarbons and spent catalyst particles which contain strippable hydrocarbons and coke;

(d) separating said lower boiling hydrocarbons from said spent catalyst particles in a separation zone and stripping said particles in a stripping zone, to remove said strippable hydrocarbons to produce stripped, coked catalyst particles;

(e) passing said stripped, coked catalyst particles into a regeneration zone in which said particles are contacted with oxygen at conditions effective to bum off said coke and produce said hot, regenerated catalyst particles, and (f) passing said hot, regenerated particles into said riser reaction zone.

21. A process according to claim 20 wherein said atomizing means comprises an orifice upstream of said tip, which increases the velocity of said two-phase fluid passing therethrough.

22. A process according to claim 21 wherein said fluid contacts a static mixing means, which mixes said two-phase fluid prior to said atomization.

* * * * *